US005308261A

United States Patent [19]

Kightlinger

[11] Patent Number: 5,308,261

[45] Date of Patent: May 3, 1994

[54] LOW PROFILE CONNECTOR POSITION ASSURANCE

[75] Inventor: John T. Kightlinger, Canfield, Ohio

[73] Assignee: General Motors Corporation, Detroit, Mich.

[21] Appl. No.: 94,599

[22] Filed: Jul. 13, 1993

[51] Int. Cl.[5] ..... H01R 13/627

[52] U.S. Cl. ..... 439/358; 439/357

[58] Field of Search ..... 439/350, 351, 352, 353, 439/354, 356-358, 345, 347, 489

[56] References Cited

U.S. PATENT DOCUMENTS 4,714,433 12/1987 Rider, Jr. ..... 439/310
4,801,275 1/1989 Ikeda et al. ..... 439/358
4,946,395 8/1990 Cope et al. ..... 439/357
5,120,240 6/1992 Reider ..... 439/358

*Primary Examiner*—Larry I. Schwartz
*Assistant Examiner*—Hien D. Vu
*Attorney, Agent, or Firm*—William A. Schuetz

[57] ABSTRACT

A one piece, low profile plastic connector assurance member for use with plug and socket connectors having a lock arm and ramp to provide a primary lock when connected together. The assurance member has a generally rectangular frame and a pair of deflectable bridge portions extending between its sides. The deflectable bridge portions engage the ramp and snap over keeper projections on the lock arm with an audible click when the connectors are properly connected to provide assurance of proper connection.

6 Claims, 2 Drawing Sheets

LOW PROFILE CONNECTOR POSITION ASSURANCE

The present invention relates to electrical connectors and, more particularly, to a low profile connector position assurance for insuring that mating electrical connector bodies are properly connected together.

U.S Pat No. 4,714,433, assigned to the same assignee as the present invention, shows an electrical connector assembly comprising a plug connector 10 which is matable with a socket connector 12 for electrically and mechanically connecting terminals connected to wires carried by the connector bodies together. The plug connector 10 had a cantilevered lock arm 18 which was deflected by a ramp 20 on the socket connector 12 and then latched behind the ramp 20 to mechanically connect the connector bodies together when the plug connector 10 was fully inserted into the socket connector 12. This patent also disclosed the use of a secondary lock member or connector position assurance 35 in the form a rectangularly shaped frame having one end pivotally connected to ears 40, 42 on the socket connector 12 and its other end snap fittable over a keeper 28 on the cantilevered lock arm 18 on the plug connector to assure that the plug and socket connectors 10, 12 were properly connected together and to provide a secondary lock.

The present invention provides a novel, completely reversible, thin or low profile connector position assurance member for use with plug and socket connectors in which one connector has the cantilevered lock arm which engages and is deflected over the ramp on the other connector member to provide a primary lock to connect the connectors together. The connector position assurance member is made of a plastic material and has a generally rectangular frame shape with a large central opening. The connector position assurance member has spaced parallel sides and ends and also has a pair of bridges or bridge portions extending transversely between its sides and at a location spaced from an adjacent end of the connector position assurance. The bridge portions are flexible toward and from their adjacent ends. The connector position assurance is completely reversible in that it has identical ends and bridge portions and identical planar top and bottom sides so that no particular orientation is required to attach it in place.

In operation, the connector position assurance member, after the plug and socket connectors are connected together, is attached by merely placing one end beneath the cantilevered lock arm adjacent the ramp and its other end over the cantilevered lock arm and then sliding the same to the rear of the lock arm. The adjacently located bridge portion has a recess for receiving the rear edge of the ramp and the bridge portion will be deflected upon its engaging the rear edge of the ramp. The lock arm on the other connector has keeper projections at its rearward end over which the other bridge portion is forced, the bridge portion deflecting and then snapping underneath the keeper projections with an audible click. When this occurs, the connector position assurance member is in place and it insures that the connectors have been properly connected together. The connector position assurance member will also provide a secondary lock function because one end will be disposed beneath the cantilevered lock arm and the other end will be disposed beneath the keeper projection on the lock arm and with the two bridge portions being biased against the rear edge of the ramp and the radially extending end of the lock arms.

If the connector position assurance member cannot be snapped into place, it is a clear indication to the operator that the mating connectors have not properly mated together.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

Figure 1:
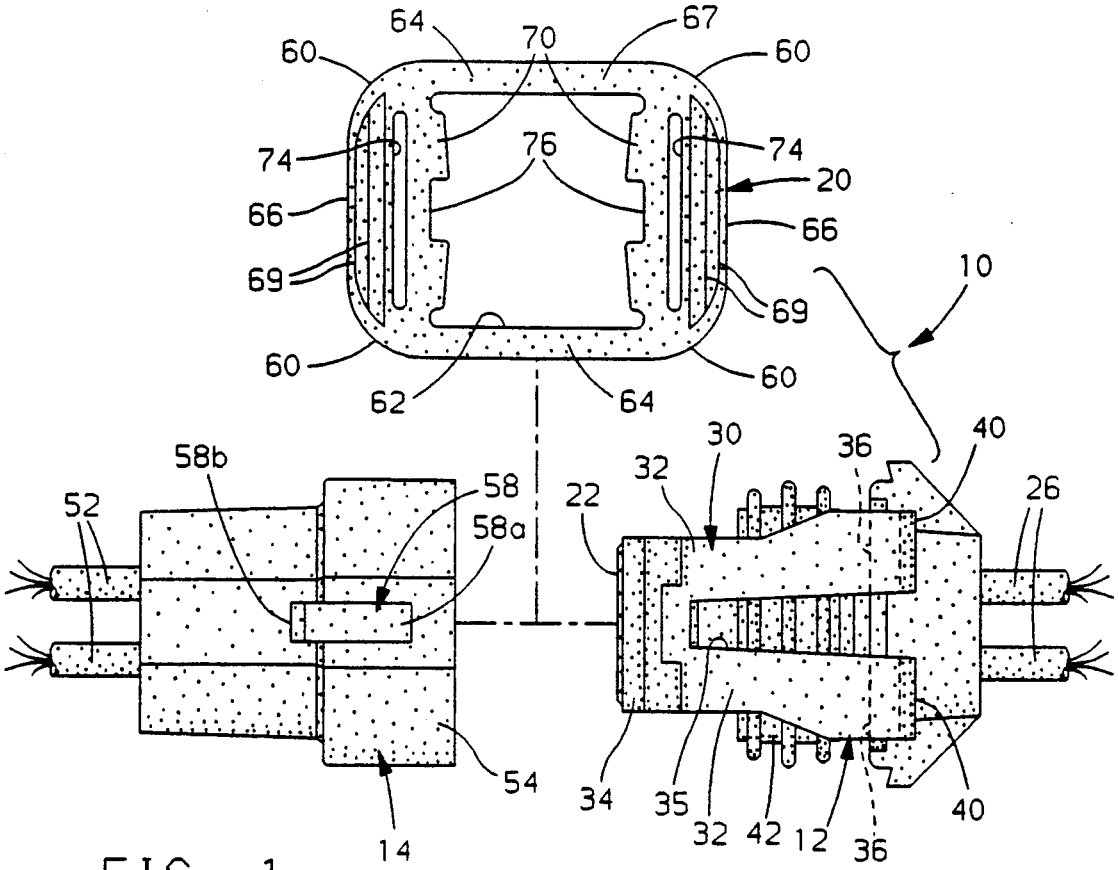
FIG. 1 is a top plan exploded view of an electrical connector assembly comprising a pair of electrical connector bodies and a connector position assurance member.
Figure 2:
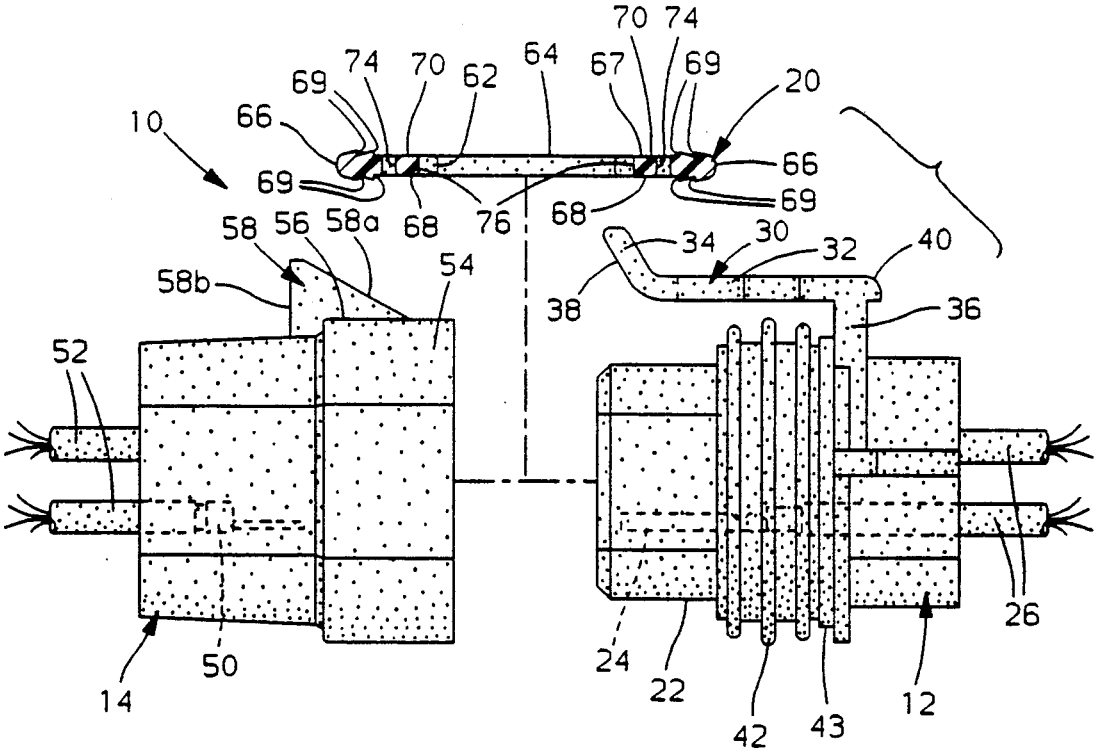
FIG. 2 is an exploded side elevational view of the electrical connector assembly shown in FIG. 1 and with the connector position assurance member being shown in cross section.

Referring to the drawings, a novel electrical connector assembly 10 is thereshown. The connector assembly 10 comprises a plug connector body or connector 12, a female socket connector or connector body 14 and a connector position assurance member 20. The plug connector 12 could be of any suitable or conventional construction and would be molded from a suitable electrically insulating plastic material and have a forward plug portion 22. The plug connector 12 has a plurality of cavities (not shown) therethrough for housing electrical terminals 24 which are suitably connected to a cables or leads 26. The terminals 24 could be of any suitable or conventional construction and would be suitably retained within the cavities in the plug connector 12.

The plug connector 12 also has a cantilevered lock arm 30 extending both radially outwardly therefrom and axially along the forward plug portion 22. The lock arm 30 is bifurcated to define a pair of spaced forwardly extending sides 32 which extend generally parallel to the longitudinal axis of the plug connector 12 and which are joined at a forward bight 34. The sides 32 are integrally connected to the plug connector 12 by radially or outwardly extending legs 36. The spaced sides define a slot 35 therebetween. The bight 34 is slanted upwardly or away from the plug portion 22 to define a ramp surface 38, and for a reason to be hereinafter more fully described. The sides 32 of the lock arm 30 at their rearward ends define keeper tabs or projections 40 which extend slightly rearwardly of the legs 36. The plug connector also is provided with an annular elastomeric seal 42 which abuts an annular flange 43 at the legs 36 of the lock arm 30.

The socket connector 14 could be of any suitable or conventional construction and would be made from a suitably electrically insulating plastic material. The socket connector 14 would have a central opening (not shown) for receiving the plug end 22 of the plug connector 12 and would have a plurality of cavities therethrough (not shown) for housing mating terminals 50 connected to cables or leads 52. The socket connector 14 at its forward end portion 54 has a generally planar upper surface 56. Integral with the upper surface 56 is an inclined ramp or tab 58 having an inclined forwardly facing surface or edge 58*a* and a rearward surface or edge 58*b* which extends perpendicular to the longitudinal axis of the socket connector 14.

The plug connector 12 is connected to the socket connector 14 by inserting the same into the central opening (not shown) in the socket connector 14. As this occurs, the inclined surface 38 of the bight 34 of the lock arm 30 will engage the inclined ramp surface 58*a* of the ramp 58 to cause the lock arm 30 to be deflected radially outwardly of the plug connector 12. This occurs until the plug connector 12 is fully mated or seated in the socket connector 14 and the bight 38 passes over the ramp 58 whereupon the self-biasing forces of the lock arm 30 causes the bight portion 34 to snap behind the rear surface 58*b* on the ramp 58 and be locked therebehind. This provides the primary lock for connecting the two connectors 12, 14 together. It should be noted that during this movement, the mating terminals 50 and 24 will be mated together and that the seal 42 would engage an inner surface (not shown) in the forward portion 54 defining the central opening in the socket connector body 14 to provide a seal between the connector bodies 12 and 14.

In accordance with the provisions of the present invention, a novel connector position assurance member 20 has been provided to insure that the plug and socket connectors 12, 14 have been properly mated together. The member 20 can be made from a suitable flexible, plastic material, but is preferably made from nylon. The connector position assurance member 20 comprises a one piece, thin or low profile member which is generally of a rectangular frame shape with rounded corners 60. The member 20 has a large central through opening 62 and has a pair of spaced parallel sides or side portions 64 and a pair of spaced parallel ends or end portions 66. The member 20 also has top and bottom, parallel, planar sides 67, 68, respectively. The ends 66 at their top and bottom sides 67, 68 are provided with spaced linear ridges 69 extending transversely between the sides 64 to aid in enabling an operator to pick up and grip the connector position assurance member 20. The member 20 also includes a pair of bridges or bridge portions 70. Each bridge portion 70 at its ends is integral with the sides 64 and extends parallel to, but spaced from, an adjacent end 66. The connector position assurance member 20 includes transversely extending elongated slots 74 to separate the bridge portions 70 from the ends 66. The bridge portions 70 can be flexed toward and from the end 66 located adjacent thereto. Each of the bridge portions 70 includes, at its middle, a notch or recess 76. The bridge portions at their ends integral with the sides 64 are of a lesser width so that the bridge portion 70 can be more readily flexed toward and from the adjacent end 66.

It should be noted that the connector position assurance member 20 has identical top and bottom sides 67, 68 identical end portions 66 and bridge portions 70 so that it can be used in a completely reversible fashion.

Figure 3:
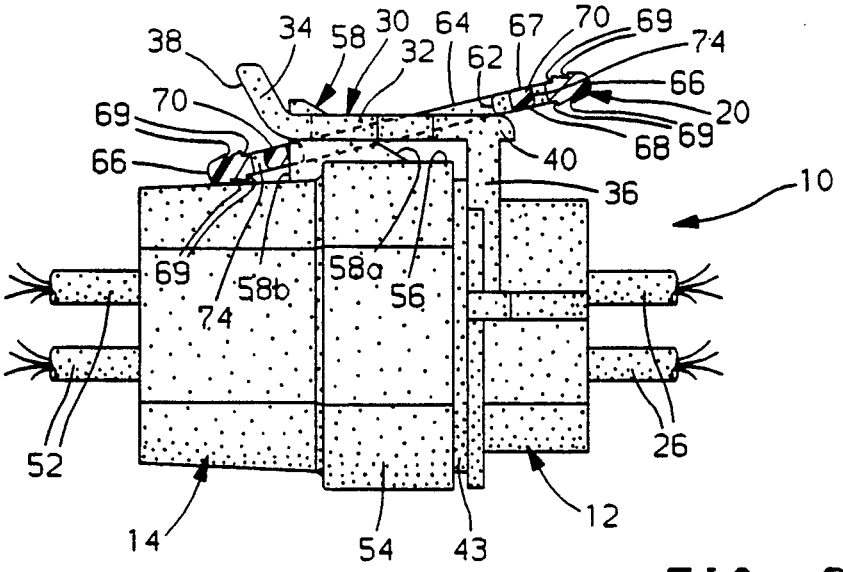
FIG. 3 is a side elevational view of the electrical connector assembly of the present invention and showing the connector position assurance member partially connected to the mated connector bodies.
Figure 4:
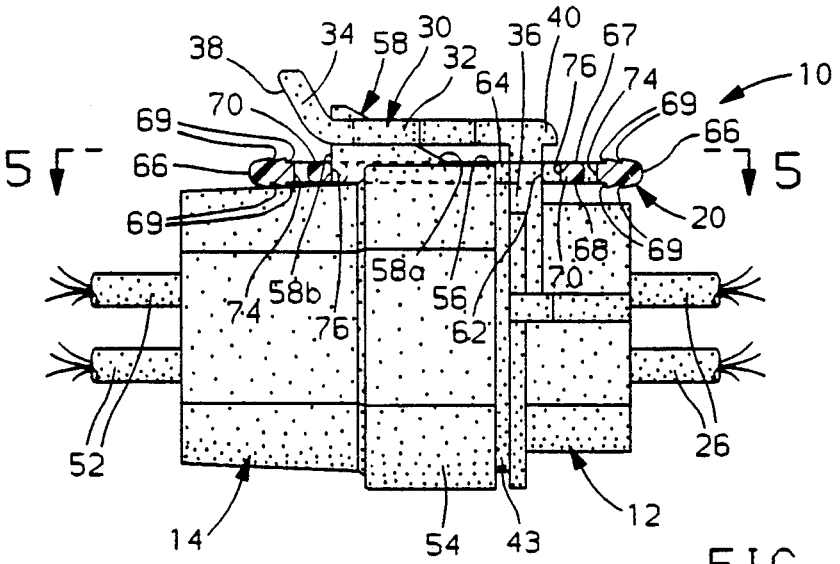
FIG. 4 is a view like that shown in FIG. 3, but showing the connector position assurance member connected to the mated connector bodies.
Figure 5:
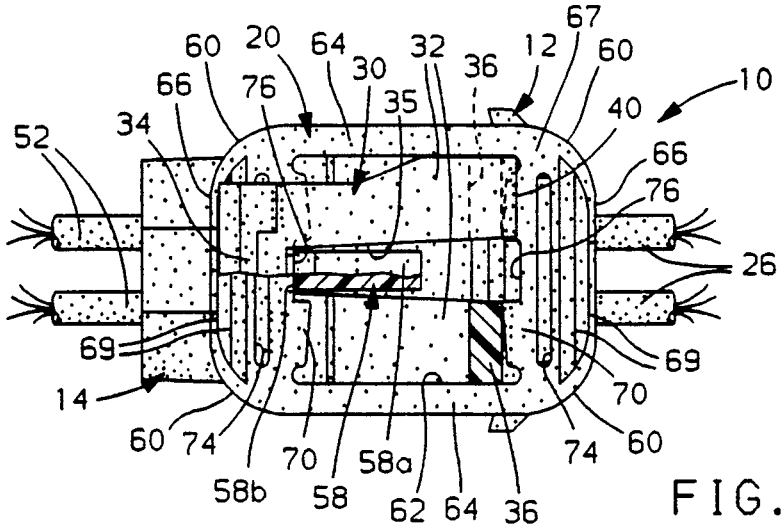
FIG. 5 is a top plan view of the electrical connector assembly shown in FIG. 4, and with portions thereof broken away and shown in section.

As best shown in FIGS. 3–5, the connector position assurance member 20 is connected to the connector assembly 10 by placing one end 66 thereof beneath the lock arm 30 and the other end 66 thereof over the lock arm 30. The connector position assurance device can then be moved forwardly and with the rear edge 58*b* of the ramp 58 being received in the adjacently located notch 76 in the bridge portion 70 and with the edge 58*b* of the ramp 58 being engageable with the bottom surface defining part of the notch 76. Further movement of the connector assurance member 20 toward the right, will cause the bridge portion 70 engaging the ramp 58 to be deflected and will cause the other bridge portion 70 overlying the lock arm 30 to engage the keeper projections 40 and then cause that bridge portion 70 to be deflected towards its adjacent end 66 until it clears the keeper projections 40 and snaps thereunder, as shown in FIG. 4. This snap over action will cause an audible click to let the operator know that the connection has been made.

It should be noted that once the plug connector 12 is connected to the socket connector 14, the position assurance member 20 can be connected thereto by the use of one hand. The audible click provides a positive indication to an operator working at a location difficult to reach and/or where he cannot see that the connectors have been properly connected. When the connector position assurance device 20 is connected to the connector assembly 10, the bridge portions 70 will biasingly engage rear surface 58*b* of the ramp 58 and the rear surface of the legs 36 to biasingly hold the connector position assurance member 20 in place without rattling. It should also be noted that the connector position assurance member 20 also provides a secondary lock in that it will prevent the connector bodies 12, 14 from being disconnected from each other.

From the foregoing, it should be apparent that a novel, one piece, low profile, completely reversible connector position assurance member has been provided which is of a simple and highly effective construction which can be applied from either end or either side, which can be attached with the use of one hand and which provides a foolproof assurance that the connector bodies have been properly mated.

Although the illustrated embodiment hereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive privilege or property is disclosed is defined as follows:

1. An electrical connector assembly having a first connector body provided with an integral deflectable cantilevered lock arm extending axially along the first connector body, a second connector body matable with the first connector body and having a transversely extending ramp, said lock arm engaging and being deflectable from a normal free state position by said ramp when said first and second connector bodies are being mated until the lock arm clears said ramp whereupon its self-biasing forces return it towards its normal free state position to lock behind the ramp to lock the connector bodies together, and a connector position assurance means for insuring that said connector bodies have been properly mated together, the improvement being that said connector position assurance means comprises a thin, planar, one piece, flexible member having a central through opening and opposed ends, said member including at least one transverse flexible bridge portion extending transversely thereacross adjacent and generally parallel to one of said ends and which can be flexed toward and from said one end, said member being connected to said connector bodies when mated by positioning it under the lock arm at one end and over the lock arm at its other end, sliding the same in an axial direction to cause said one end of said member to slide under the lock arm and toward the ramp and with the bridge portion engaging a keeper projection on the lock arm and then pushing the member toward said first connector body to cause the bridge portion to be deflected towards its adjacent end until it clears the keeper projection on the lock arm whereupon it snaps beneath the keeper projection with an audible click to insure that the connector bodies have been properly mated, said connector position assurance member not being connectable to said connector bodies if the connector bodies are not properly mated.

2. An electrical connector assembly having a first connector body provided with an integral deflectable cantilevered lock arm extending axially along the connector body, a second connector body matable with the first connector body and having a transversely extending ramp, said lock arm engaging and being deflectable from a normal free state position by said ramp when said first and second connector bodies are being mated until the lock arm clears said ramp whereupon its self-biasing forces return it towards its normal free state position to lock behind the ramp to lock the connector bodies together and form a primary lock for the connector bodies, and a connector position assurance means for insuring that said connector bodies have been properly mated together and for forming a secondary lock for the connector bodies, the improvement being that said connector position assurance means comprises a flexible, thin, planar, one piece plastic member having a central through opening and opposed parallel sides and ends which define a generally rectangularly shaped frame, said member including a pair of flexible bridge portions extending transversely of the frame between said sides and each located adjacent one of said ends and which can be flexed toward and from its adjacent end, said member being connected to said connector bodies when mated by positioning it under the lock arm at one end and over the lock arm at its other end, sliding the same in an axial direction to cause the one end of the member to slide under the lock arm and its adjacent bridge portion against the ramp and with the bridge portion adjacent the other end of the member engaging keeper projections on the lock arm and then pushing the member toward the connector bodies to cause the bridge portion adjacent said other end to be deflected towards said other end of the member until it clears the keeper projections on the lock arm whereupon it snaps beneath the keeper projections with an audible click to insure that the connector bodies have been properly mated, said bridge portions biasingly engaging said ramp and said lock arm when connected to the connector bodies, said connector position assurance member not being connectable to said connector bodies if the connector bodies are not properly mated.

3. An electrical connector assembly having a first connector body provided with an integral deflectable cantilevered lock arm extending axially along the connector body, a second connector body matable with the first connector body and having a transversely extending ramp, said lock arm engaging and being deflectable from a normal free state position by said ramp when said first and second connector bodies are being mated until the lock arm clears said ramp whereupon its self-biasing forces return it towards its normal free state position to lock behind the ramp to lock the connector bodies together and form a primary lock for the connector bodies, and a connector position assurance means for insuring that said connector bodies have been properly mated together and for forming a secondary lock for the connector bodies, the improvement being that said connector position assurance means comprises a flexible, thin, planar, one piece plastic member having a central through opening and opposed parallel sides and ends which define a generally rectangularly shaped frame, said member including a pair of flexible bridge portions extending transversely of the frame between said sides and each located adjacent one of said ends and which can be flexed toward and from its adjacent end, said member being connected to said mated connectors by positioning it under the lock arm at one end and over the lock arm at its other end, sliding the same in an axial direction to cause the one end to slide under the lock arm and its adjacent bridge portion against the ramp and with the bridge portion at the other end of the member engaging rearwardly extending keeper projections on the lock arm and then pushing the member toward the connector bodies to cause the bridge portion adjacent the other end to be deflected towards its adjacently located other end of the member until it clears the keeper projections on the lock arm whereupon it snaps beneath the keeper projections with an audible click to insure that the connector bodies have been properly mated, said bridge portions biasingly engaging said ramp and said lock arm when connected to said connector bodies when mated, said ends, bridge portions and top and bottom sides of said connector position assurance member being identical whereby said member is reversible, said connector position assurance member not being connected to said connector bodies if the connector bodies are not properly mated.

4. An electrical connector assembly, as defined in claim 3, and wherein said bridge portions have a notch at their middle to receive said ramp.

5. An electrical connector assembly, as defined in claim 4, and wherein said ends of said plastic member have linear ridges at its top and bottom sides to aid in gripping said member.

6. An electrical connector assembly, as defined in claim 5, and wherein each of said bridge portions has a narrower width at its ends than at its center.

* * * * *